US007989671B2

(12) United States Patent
Strege et al.

(10) Patent No.: US 7,989,671 B2
(45) Date of Patent: Aug. 2, 2011

(54) PROCESS FOR THE CONVERSION OF RENEWABLE OILS TO LIQUID TRANSPORTATION FUELS

(75) Inventors: Joshua R. Strege, Grand Forks, ND (US); Benjamin G. Oster, Thompson, ND (US); Paul D. Pansegrau, Grand Forks, ND (US); Chad A. Wocken, Grand Forks, ND (US); Ted R. Aulich, Gand Forks, ND (US)

(73) Assignee: Energy & Environmental Research Center Foundation, Grand Forks, ND (US)

( * ) Notice: Subject to any disclaimer, the term of this patent is extended or adjusted under 35 U.S.C. 154(b) by 344 days.

(21) Appl. No.: 12/264,689

(22) Filed: Nov. 4, 2008

(65) Prior Publication Data

US 2010/0113848 A1 May 6, 2010

(51) Int. Cl.
*C07C 1/00* (2006.01)

(52) U.S. Cl. ..... 585/733; 585/240; 44/306; 44/605

(58) Field of Classification Search ..... 585/240, 585/733; 44/306, 605
See application file for complete search history.

(56) References Cited

U.S. PATENT DOCUMENTS

| | | | | |
|---|---|---|---|---|
| 4,992,605 | A * | 2/1991 | Craig et al. | 585/240 |
| 6,420,322 | B1 | 7/2002 | Kodali | |
| 7,816,570 | B2 * | 10/2010 | Roberts et al. | 585/240 |
| 2004/0230085 | A1 * | 11/2004 | Jakkula et al. | 585/240 |
| 2006/0161032 | A1 * | 7/2006 | Murzin et al. | 585/240 |
| 2007/0112224 | A1 | 5/2007 | Krafft et al. | |
| 2007/0175795 | A1 * | 8/2007 | Yao et al. | 208/142 |
| 2008/0071125 | A1 * | 3/2008 | Li | 585/361 |
| 2009/0250376 | A1 * | 10/2009 | Brandvold et al. | 208/17 |

FOREIGN PATENT DOCUMENTS

EP 0430579 A2 6/1991

OTHER PUBLICATIONS

Weisser, O. et al. (1973). Sulphide catalysts: their properties and applications, Pergamon Press, 506 pgs.*

International Application No. PCT/US2009/063059 International Search Report dated May 26, 2010, 10 pages.

* cited by examiner

*Primary Examiner* — Robert J Hill, Jr.
*Assistant Examiner* — Brian McCaig
(74) *Attorney, Agent, or Firm* — Conley Rose, P.C.; Rodney B. Carroll

(57) ABSTRACT

A method of producing a hydrocarbon product by hydrotreating a feedstock comprising triacylglyceride (TAG) in the presence of a nonsulfided hydrotreating catalyst to produce a first product comprising hydrocarbons. A method of producing a transportation fuel by selecting an undoped feedstock comprising virgin TAG, used TAG, or a combination thereof; hydrotreating the undoped feedstock in the presence of an unsulfided hydrotreating catalyst to produce a first product; and subjecting the first product to at least one process selected from aromatization, cyclization, and isomerization; to produce a second hydrocarbon product selected from gasoline, kerosene, jet fuel, and diesel fuels.

18 Claims, No Drawings

PROCESS FOR THE CONVERSION OF RENEWABLE OILS TO LIQUID TRANSPORTATION FUELS

STATEMENT REGARDING FEDERALLY SPONSORED RESEARCH OR DEVELOPMENT

This invention was made with U.S. government support under Contract No. W911NF-07-C-0046 awarded by the Defense Advanced Research Projects Agency (DARPA). The government has certain rights in this invention.

CROSS-REFERENCE TO RELATED APPLICATIONS

Not Applicable.

BACKGROUND

1. Field of the Invention

The invention relates to a method for the conversion of renewable oils (triacylglycerides or TAGs) to hydrocarbons. The oils may be derived from plants, animals, or algae or mixtures thereof. The method is applicable to the manufacture of liquid transportation fuels, especially gasoline, kerosene, and jet and diesel fuels.

2. Background of the Invention

Increasing costs for petroleum-derived fuels are driving interest in alternative feedstocks. Additionally, concern over increasing atmospheric carbon dioxide levels has spawned interest in "carbon-neutral" fuels. One possible solution to both of these issues is the utilization of TAG feedstocks for the production of hydrocarbon-based transportation fuels.

Certain TAGs are already utilized as feedstocks for the production of "bio-diesel." In this process, the TAG is transesterified with methanol to provide a fatty acid methyl ester (FAME) and glycerine. The FAME is separated, purified, and sold as an additive, supplementing petroleum-derived diesel fuel. FAME diesel additives provide certain specific benefits to their use (i.e., lubricity), but suffer serious physical limitations when used as the sole fuel and not as a blendstock (i.e., cold-flow properties).

FAME diesel fuel represents a first-generation bio-derived fuel. The shortcomings of this generation of fuel are directly related to the fuel-possessing oxygen functionality. A second-generation fuel possesses no oxygen functionality, providing a more petroleum-like product with respect to elemental composition, and is oftentimes termed "renewable diesel."

Both Natural Resources Canada and Fortum Oil (now known as Neste Oil) have described processes and methods for the conversion of renewable feedstocks to diesel fuel. Although these second-generation fuel processes remove oxygen functionality of the fuel, these hydrodeoxygenation processes do not control the amount of even- and odd-numbered hydrocarbon chains.

Canadian Patent 2,149,685 (Natural Resources Canada) describes the conversion of depitched tall oil to a diesel fuel additive. The patent describes a hydrodeoxygenation process utilizing a hydrotreating catalyst. The catalyst is activated by presulfiding. The sulfided nature of the catalyst may be maintained by adding sulfur to the tall oil feedstock at a level of 1000 ppm. The doping agent is carbon disulfide. The hydrodeoxygenation conversion is then performed at 410° C. and 1200 psi.

United States patent application 2007/0010682 (Neste Oil) describes the preparation of a diesel fuel from a vegetable TAG oil. The TAG oil is doped with 50 to 20,000 ppm sulfur. The hydrodeoxygenation step is performed between 580 psi and 725 psi and 305° C. and 360° C.

Accordingly, there is a need for a method of producing paraffinic hydrocarbons from a feedstock comprising TAGs without the need for presulfiding the hydrotreating catalyst or doping the feedstock with sulfur. In addition, there is a need for a hydrotreating process where the resulting hydrocarbon chain lengths are distributed similarly as in conventional petroleum-derived fuels.

SUMMARY

Herein disclosed is a method of producing a hydrocarbon product by hydrotreating a feedstock comprising TAG in the presence of a nonsulfided hydrotreating catalyst to produce a first product comprising hydrocarbons. The feedstock comprising TAG may be selected from the group consisting of yellow grease, brown grease, virgin TAG, and combinations thereof. The method may further comprise selecting a feedstock comprising a ratio of virgin TAG to used TAG such that the first product has a desired composition of hydrocarbons. Hydrotreating may provide a hydrocarbon product possessing both even- and odd-numbered carbon chains. Hydrotreating may comprise decarboxylation and decarbonylation reactions.

In applications, the nonsulfided hydrotreating catalyst comprises at least one metal selected from Groups VIII and VIB of the Periodic Table. In embodiments, the hydrotreating catalyst comprises at least one metal selected from the group consisting of palladium (Pd), platinum (Pt), nickel (Ni), and combinations thereof. The hydrotreating catalyst may comprise nickel and molybdenum (Mo) or cobalt (Co) and molybdenum. The hydrotreating catalyst further comprises a support selected from alumina, silica, and combinations thereof. In embodiments, the feedstock is not doped with sulfur prior to hydrotreating.

Hydrotreating may be performed at a temperature in the range of from about 340° C. to about 400° C. and a pressure in the range of from about 100 psig to about 200 psig. The first product may comprise at least 50% normal alkanes. In applications, the first product comprises at least 70% normal alkanes. The first product may further comprise at least 10% normal alkenes.

The method may further comprise subjecting the first product to at least one process selected from isomerization, cyclization, and aromatization to produce a fuel selected from the group consisting of gasoline, kerosene, jet, and diesel fuels.

In some embodiments, hydrotreating is performed at a temperature in the range of from about 470° C. to about 530° C. and a pressure in the range of from about 750 psig to about 1000 psig. The first product may comprise primarily saturated and aromatic hydrocarbons The first product may be suitable as a liquid transportation fuel with minimal or no secondary petroleum refining and processing operations. In embodiments, the first product further comprises olefinic hydrocarbons, and the ratio of the saturated hydrocarbons to the aromatic hydrocarbons to the olefinic hydrocarbons in the first product may be varied so as to produce feedstocks ideally suited for the production of at least one fuel selected from gasoline, kerosene, jet, and diesel fuels.

Also disclosed is a method of producing a transportation fuel, the method comprising: selecting an undoped feedstock comprising virgin TAG, used TAG, or a combination thereof; hydrotreating the undoped feedstock in the presence of an unsulfided hydrotreating catalyst to produce a first product; and subjecting the first product to at least one process selected from aromatization, cyclization, and isomerization, to produce a second hydrocarbon product selected from gasoline, kerosene, jet, and diesel fuels. The first product may comprise aromatic, saturated and olefinic hydrocarbons, and the composition of the feedstock may be selected such that the ratio of saturated to aromatic to olefinic hydrocarbons in the first product is suitable for the production of the second hydrocarbon product. Hydrotreating may be performed in the absence of sulfur injection into the process or the feedstock.

Notation and Nomenclature

The term "brown grease" comprises trap grease, sewage grease (e.g., from a sewage plant), and black grease. Brown grease from traps and sewage plants are typically unsuitable for use as animal feed. The term "brown grease" also encompasses other grease having a free fatty acid (FFA) content greater than 20% and being unsuitable for animal feed.

The term "yellow grease" comprises used frying oils from deep fryers and restaurant grease traps. It also encompasses lower-quality grades of tallow from rendering plants.

Fatty acids can be bound or attached to other molecules, such as in triglycerides or phospholipids. When they are not attached to other molecules, they are known as "free" fatty acids. The uncombined fatty acids or free fatty acids may come from the breakdown of a triglyceride into its components (fatty acids and glycerol). For example a free fatty acid may break off through hydrolysis, for example, steam from cooking foods, salts, chemicals, heat, etc., work together to break chains off triglycerides. In the presence of catalyst (e.g., acid), a free fatty acid may combine with a methanol to produce a molecule of biodiesel. The FFA in crude vegetable oils range from about 1% to about 4% (olive oil may comprise up to about 20%). The amount of FFA in yellow grease (e.g., recycled cooking oil) generally ranges from about 4% to about 15%. Brown grease (e.g., trap grease) may comprise a FFA composition of from about 50% to 100% of raw material.

Here the term "hydrotreatment" is used to refer to a catalytic process whereby oxygen is removed from organic compounds as water (hydrodeoxygenation); sulfur from organic sulfur compounds as dihydrogen sulfide (hydrodesulfurization); nitrogen from organic nitrogen compounds as ammonia (hydrodenitrogenation); and halogens, for example, chlorine from organic chloride compounds as hydrochloric acid (hydrodechlorination).

The term "normal alkanes" is used to refer to n-paraffins or linear alkanes that do not contain side chains.

DETAILED DESCRIPTION

I. Overview

It is the purpose of this invention to describe a method and process by which renewable feedstocks can be converted to gasoline, kerosene, jet fuels, and diesel fractions. According to this disclosure, TAG feedstocks are converted to a product comprising paraffinic hydrocarbons without the need for presulfiding of a hydrotreating catalyst or the requirement of the feedstock being doped with sulfur. In embodiments, TAG feedstocks are converted to a product comprising paraffinic hydrocarbons whereby the hydrocarbon chain length distribution is controlled to provide a distribution that is similar to petroleum-derived fuels. Control of the process may be achieved by allowing for simultaneous decarbonylation and decarboxylation reactions. Key control parameters are the temperature, pressure, and the use of a nonsulfided hydrotreating catalyst. The nonsulfided hydrotreating catalyst allows for both the decarbonylation and decarboxylation reactions to run simultaneously over a range of conditions. The results show (vide infra) that TAG feedstock can be converted to a paraffinic product at lower temperatures and pressures than those described previously. The paraffinic product may further undergo isomerization, cyclization, and/or aromatization steps to provide distinct blendstocks. When skillfully blended, these distinct blendstocks can become drop-in compatible and fit-for-purpose gasoline, kerosene, jet fuels, or diesel fuels. These fuels have similar chemical composition as the hydrocarbons and are fully fungible with petroleum-derived fuels. That is, the fuels produced may be identical in virtually all respects to commercially available petroleum-derived fuels.

According to this disclosure, a feedstock comprising TAG is hydrotreated (hydrodeoxygenated). The TAG may be obtained from terrestrial or marine sources. The TAG feedstock may comprise triacylglycerides derived from plants, triglycerides derived from animals, triglycerides derived from algae, or combinations thereof. The TAG feedstock may further comprise diacylglycerides, monoacylglycerides, FFAs, and combinations thereof as contaminants. The TAG feedstock may comprise yellow grease, brown grease, or a combination thereof. The TAG feedstock may comprise a blend of fresh TAG and used TAG (i.e. yellow grease and/or brown grease). According to this disclosure, the feedstock is not doped with sulfur. The ratio of the virgin and used TAG and/or the composition of the TAG feedstock may be selected such that hydrotreating produces a desired hydrocarbon product slate.

The TAG feedstock is hydrotreated using a hydrotreating catalyst that is not presulfided. In the hydrotreating, TAG, fatty acids, and fatty acid derivatives in the TAG feedstock are deoxygenated, denitrogenated, and desulfurized. The hydrotreating catalyst may be any nonsulfided hydrotreating catalyst. In embodiments, the hydrotreating catalyst is a nonsulfided hydrogenation catalyst. The hydrotreating catalyst may contain one or more metals from Group VIII and VIB of the Periodic Table of the Elements. The one or more metals may be selected from palladium (Pd), platinum (Pt), nickel (Ni), and combinations thereof. In embodiments, the catalyst is a NiMo catalyst comprising nickel and molybdenum. In embodiments, the catalyst is a CoMo catalyst comprising cobalt and molybdenum. The hydrotreating catalyst may comprise supported or unsupported metals. In embodiments, the catalyst comprises a support. In applications, the support comprises alumina, silica, or a combination thereof. The catalyst may be a supported NiMo or CoMo catalyst. In embodiments, $NiMo/Al_2O_3_SiO_2$ or $CoMo/Al_2O_3$ catalyst is utilized.

II. Product Comprising Predominantly Normal Alkanes

In applications, a product comprising predominantly normal alkanes is produced. In such applications, the hydrotreating of the TAG feedstock is operated at modest temperatures and pressures (relative to referenced methods). In these embodiments, the temperature is in the range of from about 340° C. to 410° C. In embodiments, the temperature is in the range of from about 390° C. to 410° C. In embodiments, the temperature is about 400° C. Preferred pressures in such applications are in the range of from about 100 psig to 200 psig. In some embodiments, the pressure is in the range of from about 150 psig to about 200 psig. In embodiments, the temperature is about 400° C., and the pressure is about 200 psig. Suitable pressure is below that typically employed in processes utilizing sulfided hydrotreating catalysts.

The paraffinic hydrocarbon product produced in this manner may comprise predominantly normal alkanes. The product may comprise more than about 50% normal alkanes, more than 60% normal alkanes, more than 70% normal alkanes, or about 73% normal alkanes. The product may further comprise normal alkenes. The product may comprise more than about 10% normal alkenes, more than 15% normal alkenes, more than about 20% normal alkenes, or about 10% normal alkenes. The paraffinic product may further comprise a trace of fatty acid. The product may comprise less than about 20% fatty acids, less than about 15% fatty acids, less than about 5% fatty acids, or less than or about 3% fatty acids. This desired outcome is achievable through the use of a nonsulfided hydrotreating catalyst, thus providing excellent conversion of TAG feedstock to paraffinic product. The paraffinic product is convertible to liquid transportation fuels by standard petroleum refining and processing methods. For example, the paraffinic product may further undergo isomerization, cyclization, and/or aromatization steps to provide distinct blendstocks from which desired transportation fuels may be obtained.

This application offers advantages over prior art in that the very nature of the catalyst is different, thus potentially offering the ability to operate at lower temperatures and/or pressures while achieving the same or superior outcome as prior art. This may offer economic advantages in large-scale production settings.

III. Product Comprising Saturated and Aromatic Hydrocarbons

In another embodiment, higher pressures may be utilized in order to produce a product comprising aromatic hydrocarbons along with saturated hydrocarbons. The operating temperature for such embodiments may be in the range of from about 470° C. to 530° C. In embodiments, the temperature is in the range of from about 480° C. to 500° C. In embodiments, the temperature is about 480° C. The operating pressure may be in the range of from about 650 psig to about 1000 psig. In embodiments, the hydrotreating pressure may be in the range of from about 700 psig to 800 psig. In some applications, the pressure is about 750 psig. In some applications, the temperature is about 480° C., and the pressure is about 750 psig.

In embodiments, the TAG feedstock is converted to a product comprising predominantly saturated hydrocarbons and aromatic hydrocarbons. The saturated/aromatic hydrocarbon product produced in this manner may comprise predominantly saturated hydrocarbons. The product may comprise more than about 60% saturated hydrocarbons, more than about 70% saturated hydrocarbons, more than about 75% saturated hydrocarbons or about 77% saturated hydrocarbons. The saturated/aromatic hydrocarbon product may comprise more than about 10% aromatic hydrocarbons, more than about 20% aromatic hydrocarbons, more than about 30% aromatic hydrocarbons, or about 17% aromatic hydrocarbons. In embodiments, the saturated/aromatic product further comprises alkene hydrocarbons. The product may comprise less than about 20% normal alkenes, less than about 10% normal alkenes, or less than about 3% normal alkenes.

The composition of the TAG feedstock may be selected such that the ratios of saturated hydrocarbons to aromatic hydrocarbons to olefinic hydrocarbons are ideally suited to the production of a desired fuel selected from gasoline, kerosene, jet fuels, and diesel fuels. For example, such a saturated/aromatic product may be useful in the production of jet fuel, with minimal secondary processing being required. Secondary processing may comprise standard petroleum refining and processing methods. The amount of aromatic hydrocarbon in the saturated/aromatic product may also be modulated by adjusting the temperature. It should be noted that these conditions offer a direct and economical path for the production of liquid transportation fuels, especially jet fuel, which require minimal secondary processing.

IV. EXAMPLES

Examples 1-9

Coconut Oil

The apparatus for all experiments was a continuous-flow reactor comprising a pump system, a gas flow system, a high-pressure reactor vessel, a reactor heater and temperature regulation device, a product collection receptacle, and a pressure regulation device. Appropriate instrumentation and electronics were attached to the whole device to enable control and recording of experimental conditions. Samples of product were removed through the sample receptacle and analyzed with appropriate analytical instrumentation (i.e., gas chromatography-mass spectrometry [GC-MS]). Hydrogen was supplied to the reactor system from purchased cylinders. TAG material was supplied to the reactor system via a high-pressure pumping system. In the first series of examples, 1.12 kg of a nonsulfided hydrotreating catalyst was charged to the reactor chamber. The chamber possessed a length-to-diameter ratio of 6. The catalyst was activated by warming to greater than 300° C. while a flow of hydrogen gas was passed over the catalyst. The moisture content of the exiting gas was measured. The activation was judged complete when the water content of the exiting gas decreased.

Example 1

Coconut oil was supplied to the reactor at a rate of 1 pound/hour. Hydrogen was supplied at a rate of 20 standard cubic feet per hour (scfh). The reactor was maintained at 340° C. The hydrogen pressure was regulated to 80 psi. The temperature and flow conditions were maintained for 3 hours once steady-state conditions were achieved. The product was collected and analyzed. Results are shown in Table 1.

Example 2

Coconut oil was supplied to the reactor at a rate of 1 pound/hour. Hydrogen was supplied at a rate of 20 scfh. The reactor was maintained at 350° C. The hydrogen pressure was regulated to 100 psi. The temperature and flow conditions were maintained for 3 hours once steady-state conditions were achieved. The product was collected and analyzed. Results are shown in Table 1.

Example 3

Coconut oil was supplied to the reactor at a rate of 2 pounds/hour.

Hydrogen was supplied at a rate of 40 scfh. The reactor was maintained at 350° C. The hydrogen pressure was regulated to 100 psi. The temperature and flow conditions were maintained for 3 hours once steady-state conditions were achieved. The product was collected and analyzed. Results are shown in Table 1.

Example 4

Coconut oil was supplied to the reactor at a rate of 1 pound/hour. Hydrogen was supplied at a rate of 20 scfh. The reactor was maintained at 350° C. The hydrogen pressure was regulated to 200 psi. The temperature and flow conditions were maintained for 3 hours once steady-state conditions were achieved. The product was collected and analyzed. Results are shown in Table 1.

Example 5

Coconut oil was supplied to the reactor at a rate of 2 pounds/hour.

Hydrogen was supplied at a rate of 40 scfh. The reactor was maintained at 350° C. The hydrogen pressure was regulated to 200 psi. The temperature and flow conditions were maintained for 3 hours once steady-state conditions were achieved. The product was collected and analyzed. Results are shown in Table 1.

Example 6

Coconut oil was supplied to the reactor at a rate of 1 pound/hour. Hydrogen was supplied at a rate of 20 scfh. The reactor was maintained at 400° C. The hydrogen pressure was regulated to 100 psi. The temperature and flow conditions were maintained for 3 hours once steady-state conditions were achieved. The product was collected and analyzed. Results are shown in Table 1.

Example 7

Coconut oil was supplied to the reactor at a rate of 2 pounds/hour. Hydrogen was supplied at a rate of 40 scfh. The reactor was maintained at 400° C. The hydrogen pressure was regulated to 100 psi. The temperature and flow conditions were maintained for 3 hours once steady-state conditions were achieved. The product was collected and analyzed. Results are shown in Table 1.

Example 8

Coconut oil was supplied to the reactor at a rate of 1 pound/hour.

Hydrogen was supplied at a rate of 20 scfh. The reactor was maintained at 400° C. The hydrogen pressure was regulated to 200 psi. The temperature and flow conditions were maintained for 3 hours once steady-state conditions were achieved. The product was collected and analyzed. Results are shown in Table 1.

Example 9

Canola oil was supplied to the reactor at a rate of 1 pound/hour. Hydrogen was supplied at a rate of 50 scfh. The reactor was maintained at 400° C. The hydrogen pressure was regulated to 200 psi. The temperature and flow conditions were maintained for 3 hours once steady-state conditions were achieved. The product was collected and analyzed. Results are shown in Table 1.

TABLE 1

Results from First Test Matrix

| Example | Oil Flow, lb/hr | Temp., ° C. | Pressure, psig | $H_2$ Flow, scfh | Saturated Hydrocarbons, % | Olefinic Hydrocarbons, % | Fatty Acids, % |
|---|---|---|---|---|---|---|---|
| 1 | 1 | 340 | 80 | 20 | 43.8 | 27.4 | 19 |
| 2 | 1 | 350 | 100 | 20 | 27.2 | 33.9 | 26.9 |
| 3 | 2 | 350 | 100 | 40 | 21.8 | 26.1 | 40 |
| 4 | 1 | 350 | 200 | 20 | 50.4 | 18 | 16 |
| 5 | 2 | 350 | 200 | 40 | 27.3 | 20 | 41.9 |
| 6 | 1 | 400 | 100 | 20 | 40.6 | 37 | 7.4 |
| 7 | 2 | 400 | 100 | 40 | 37.7 | 32.3 | 16.9 |
| 8 | 1 | 400 | 200 | 20 | 73.5 | 10.5 | 3.2 |
| 9 | 2 | 400 | 200 | 50 | 63.3 | 13.8 | 2.2 |

Examples 10-17

Yellow Grease

For the second series of experiments, a smaller reactor system was utilized. The reactor tube possessed a length-to-diameter ratio of about 40. The tube was loaded with a total of about 70 grams of catalyst for the experiments listed below. The feedstock for this series of examples was waste TAG (yellow grease) obtained from a french fry factory. The yellow grease possessed a significant (2.6%) FFA content.

Example 10

Yellow grease was supplied to the reactor at a rate of 1 milliliter/minute (mL/min). Hydrogen was supplied at a rate of 1064 standard cubic centimeters/minute (sccm). The reactor was maintained at 474° C. The hydrogen pressure was regulated to 750 psi. The temperature and flow conditions were maintained for 30 minutes once steady-state conditions were achieved. The product was collected and analyzed. Results are shown in Table 2.

A mixture of hydrodeoxygenation, decarboxylation, and decarbonylation reactions occur simultaneously during the conversion of TAG to hydrocarbon product. The hydrodeoxygenation reactions provide a hydrocarbon product possessing even-numbered carbon chains, such as octadecane. The decarboxylation and decarbonylation reactions provide a hydrocarbon product possessing odd-numbered carbon chains such as heptadecane. The ratio of C17 to C18 product observed is 0.79 to 1. Coincident cracking reactions provide a mixture of lower normal hydrocarbons. The observed ratios of even- and odd-numbered hydrocarbon chains are C15:C16=0.57, C13:C14=1.22, C11:C12=1.15, C9:C10=1.11, C7:C8=1.03.

The simultaneous production of both even and odd carbon chains of varying lengths serves to facilitate the ultimate production of a petroleum-like final fuel product (i.e. gasoline, kerosene, jet fuel, or diesel).

Example 11

Yellow grease was supplied to the reactor at a rate of 1 mL/min. Hydrogen was supplied at a rate of 1050 sccm. The reactor was maintained at 480° C. The hydrogen pressure was regulated to 750 psi. The temperature and flow conditions were maintained for 30 minutes once steady-state conditions were achieved. The product was collected and analyzed. Results are shown in Table 2.

Example 12

Yellow grease was supplied to the reactor at a rate of 1 mL/min. Hydrogen was supplied at a rate of 1050 sccm. The reactor was maintained at 490° C. The hydrogen pressure was regulated to 750 psi. The temperature and flow conditions were maintained for 30 minutes once steady-state conditions were achieved. The product was collected and analyzed. Results are shown in Table 2.

Example 13

Yellow grease was supplied to the reactor at a rate of 1 mL/min. Hydrogen was supplied at a rate of 1050 sccm. The reactor was maintained at 502° C. The hydrogen pressure was regulated to 750 psi. The temperature and flow conditions were maintained for 30 minutes once steady-state conditions were achieved. The product was collected and analyzed. Results are shown in Table 2.

Example 14

Yellow grease was supplied to the reactor at a rate of 1 mL/min. Hydrogen was supplied at a rate of 1050 sccm. The reactor was maintained at 530° C. The hydrogen pressure was regulated to 750 psi. The temperature and flow conditions were maintained for 30 minutes once steady-state conditions were achieved. The product was collected and analyzed. Results are shown in Table 2.

Example 15

Yellow grease was supplied to the reactor at a rate of 1.5 mL/min. Hydrogen was supplied at a rate of 1050 sccm. The reactor was maintained at 498° C. The hydrogen pressure was regulated to 750 psi. The temperature and flow conditions were maintained for 30 minutes once steady-state conditions were achieved. The product was collected and analyzed. Results are shown in Table 2.

Example 16

Yellow grease was supplied to the reactor at a rate of 4.5 mL/min. Hydrogen was supplied at a rate of 1066 sccm. The reactor was maintained at 482° C. The hydrogen pressure was regulated to 750 psi. The temperature and flow conditions were maintained for 30 minutes once steady-state conditions were achieved. The product was collected and analyzed. Results are shown in Table 2.

Example 17

Yellow grease was supplied to the reactor at a rate of 4.5 mL/min. Hydrogen was supplied at a rate of 1088 sccm. The reactor was maintained at 487° C. The hydrogen pressure was regulated to 750 psi. The temperature and flow conditions were maintained for 30 minutes once steady-state conditions were achieved. The product was collected and analyzed. Results are shown in Table 2.

TABLE 2

Results from Yellow Grease as Feedstock

| Example | Oil Flow, mL/min | Temp., ° C. | Pressure, psig | $H_2$ Flow, sccm | Saturated Hydrocarbon | Aromatic Hydrocarbon | Olefinic Hydrocarbon |
|---|---|---|---|---|---|---|---|
| 10 | 1 | 474 | 750 | 1064 | 90% | 9% | 0% |
| 11 | 1 | 480 | 750 | 1050 | 77% | 17% | 3% |
| 12 | 1 | 490 | 750 | 1050 | 64% | 32% | 1% |
| 13 | 1 | 502 | 750 | 1050 | 56% | 39% | 2% |
| 14 | 1 | 530 | 750 | 1050 | 37% | 60% | 1% |
| 15 | 1.5 | 498 | 750 | 1050 | 91% | 7% | 2% |
| 16 | 4.5 | 482 | 750 | 1066 | 63% | 7% | 21% |
| 17 | 4.5 | 487 | 750 | 1088 | 62% | 13% | 23% |

Example 18

Product Fuels

Hydrocarbon product obtained from process conditions such as those described in Tables 1 and 2 was subjected to petroleum-refining operations, including isomerization, aromatization, hydrogenation, and distillation under conditions known to those skilled in the art, such that a fuel was produced that complied with the military specification for JP-8 (MIL-DTL-83133E). The fuel possessed a flash point of 49° C., a freeze point of −52° C., and an energy density of 42.9 MJ/kg. Furthermore, the fuel complied with all aspects of MIL-DTL-83133E, including physical density, distillation (D-86), etc.

The processing of TAG, either virgin or waste, according to the examples above, provides a fuel possessing properties consistent with drop-in compatibility and fit-for-purpose usage, according to either MIL-DTL-83133E or MIL-DTL-83133F.

While preferred embodiments of the invention have been shown and described, modifications thereof can be made by one skilled in the art without departing from the spirit and teachings of the disclosure. The embodiments described herein are exemplary only and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes 2, 3, 4, etc.; greater than 0.10 includes 0.11, 0.12, 0.13, etc.). Use of the term "optionally" with respect to any element of a claim is intended to mean that the subject element is required or, alternatively, is not required. Both alternatives are intended to be within the scope of the claim. Use of broader terms such as comprises, includes, having, etc., should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference is not an admission that it is prior art to the present invention, especially any reference that may have a publication date after the priority date of this application. The disclosures of all patents, patent applications, and publications cited herein are hereby incorporated by reference, to the extent they provide exemplary, procedural, or other details supplementary to those set forth herein.

REFERENCES

1. Craig, W. K.; Soveran, D. W. Production of Hydrocarbons with a Relatively High Cetane Rating. U.S. Pat. No. 4,992,605, Feb. 12, 1991.
2. Monnler, J.; Tourigny, G.; Soveran, D. W.; Wong, A.; Hogan, E. N.; Stumberg, M. U.S. Pat. No. 5,705,722, Jan. 6, 1998.
3. Monnler, J.; Tourigny, G.; Soveran, D. W. Canadian Patent 2,149,685, Jun. 30, 1994.
4. Myllyoja, J.; Aalto, P.; Savolainen, P.; Purola, V. M.; Alopaeus, V.; Gronqvist, J. U.S. Patent Application 2007/0010682 A1, Jan. 11, 2007.
5. Kalnes, T.; Marker, T.; Shonnard, D. R. *International Journal of Chemical Reactor Engineering* 2007, 5, A48.
6. Nikkonen, J.; Purola, V. M.; Myllyoja, J.; Aalto, P.; Lehtonen, J.; Alopaeus, V. European Patent Application 1,396,531 A2, Sep. 5, 2003.
7. Murzin, D.; Kubickova, I.; Snare, M.; Maki-Arvela, P.; Myllyoja, J. World Patent 2006/075057 A2, Jul. 20, 2006.
8. Jakkula, J.; Aalto, P.; Niemi, V.; Kiiski, U.; Nikkonen, J.; Mikkonen, S. World Patent 2004/022674 A1, Mar. 18, 2004.
9. Myllyoja, J.; Aalto, P.; Savolainen, P.; Purola, V. M.; Alopaeus, V.; Gronqvist, J. World Patent 2007/003709 A1, Jan. 11, 2007.

What is claimed is:

1. A method of producing a hydrocarbon product, the method comprising:

hydrotreating a feedstock comprising TAG in the presence of a nonsulfided hydrotreating catalyst comprising at least one metal selected from the group consisting of palladium, platinum, nickel, and combinations thereof to produce a first product comprising hydrocarbons, wherein hydrotreating is performed at a temperature in the range of from about 470° C. to about 530° C. and a pressure in the range of from about 750 psig to about 1000 psig.

2. The method of claim 1 wherein the feedstock comprising TAG is selected from the group consisting of yellow grease, brown grease, virgin TAG, and combinations thereof.

3. The method of claim 2 further comprising selecting a feedstock comprising at least one of virgin TAG, used TAG, and a combination of virgin TAG and used TAG.

4. The method of claim 1 wherein hydrotreating provides a hydrocarbon product possessing both even and odd numbered carbon chains.

5. The method of claim 4 wherein hydrotreating comprises decarboxylation and decarbonylation reactions.

6. The method of claim 1 wherein the hydrotreating catalyst further comprises a support selected from alumina, silica, and combinations thereof.

7. The method of claim 1 wherein the feedstock is not doped with sulfur prior to hydrotreating.

8. The method of claim 1 wherein hydrotreating is performed at a temperature in the range of from about 480° C. to about 500° C. and a pressure in the range of from about 750 psig to about 800 psig.

9. The method of claim 8 wherein the first product comprises at least 50% normal alkanes.

10. The method of claim 9 wherein the first product comprises at least 70% normal alkanes.

11. The method of claim 9 wherein the first product further comprises at least 10% normal alkenes.

12. The method of claim 8 further comprising subjecting the first product to at least one process selected from isomerization, cyclization, and aromatization to produce a fuel selected from the group consisting of gasoline, kerosene, jet, and diesel fuels.

13. The method of claim 1 wherein the first product comprises primarily saturated and aromatic hydrocarbons.

14. The method of claim 13 wherein the first product is suitable as a liquid transportation fuel with minimal or no secondary petroleum refining and processing operations.

15. The method of claim 13 wherein the first product further comprises olefinic hydrocarbons, and wherein the ratio of the saturated hydrocarbons to the aromatic hydrocarbons to the olefinic hydrocarbons in the first product may be varied so as to produce feedstocks ideally suited for the production of at least one fuel selected from gasoline, kerosene, jet, and diesel fuels.

16. A method of producing a transportation fuel, the method comprising:

selecting an undoped feedstock comprising virgin TAG, used TAG, or a combination thereof;

hydrotreating the undoped feedstock in the presence of an unsulfided hydrotreating catalyst comprising at least one metal selected from the group consisting of palladium, platinum, nickel, and combinations thereof to produce a first product, wherein hydrotreating is performed at a temperature in the range of from about 470° C. to about 530° C. and a pressure in the range of from about 750 psig to about 1000 psig; and subjecting the first product to at least one process selected from aromatization, cyclization, and isomerization, to produce a second hydrocarbon product selected from gasoline, kerosene, jet, and diesel fuels.

17. The method of claim 16 wherein the first product comprises aromatic, saturated and olefinic hydrocarbons and wherein the composition of the feedstock is selected such that the ratio of saturated to aromatic to olefinic hydrocarbons in the first product is suitable for the production of the second hydrocarbon product.

18. The method of claim 16 wherein the hydrotreating is performed in the absence of sulfur injection into the process or the feedstock.

* * * * *